US009972900B2

(12) United States Patent
Okunaga et al.

(10) Patent No.: US 9,972,900 B2
(45) Date of Patent: May 15, 2018

(54) DISTRIBUTOR AND PLANAR ANTENNA

(71) Applicants: Nippon Pillar Packing Co., Ltd., Osaka (JP); Fujitsu Ten Limited, Hyogo (JP)

(72) Inventors: Takeshi Okunaga, Osaka (JP); Akira Nakatsu, Osaka (JP); Eisuke Hayakawa, Hyogo (JP); Hiroaki Yoshitake, Hyogo (JP)

(73) Assignees: Fujitsu Ten Limited, Hyogo (JP); Nippon Pillar Packing Co., Ltd., Osaka (JP)

( * ) Notice: Subject to any disclaimer, the term of this patent is extended or adjusted under 35 U.S.C. 154(b) by 98 days.

(21) Appl. No.: 14/836,981

(22) Filed: Aug. 27, 2015

(65) Prior Publication Data

US 2016/0079674 A1 Mar. 17, 2016

(30) Foreign Application Priority Data

Sep. 16, 2014 (JP) ..... 2014-188244

(51) Int. Cl.

| | |
|---|---|
| ***H01Q 11/02*** | (2006.01) |
| ***H01Q 1/38*** | (2006.01) |
| ***H01Q 13/20*** | (2006.01) |
| ***H01Q 21/00*** | (2006.01) |
| ***H01Q 21/06*** | (2006.01) |
| ***H01P 5/12*** | (2006.01) |

(52) U.S. Cl.

CPC ..... *H01Q 1/38* (2013.01); *H01P 5/12* (2013.01); *H01Q 13/206* (2013.01); *H01Q 21/0075* (2013.01); *H01Q 21/065* (2013.01)

(58) Field of Classification Search

CPC ..... H01Q 11/02; H01Q 1/00; H01Q 9/065; H01Q 21/22; H01Q 1/246

USPC ..... 343/737, 844, 853, 893

See application file for complete search history.

(56) References Cited

U.S. PATENT DOCUMENTS

2008/0117004 A1* 5/2008 Mochizuki ..... H01P 1/203 333/204

2013/0027259 A1* 1/2013 Fujita ..... H01Q 9/0478 343/731

FOREIGN PATENT DOCUMENTS

JP H11-330811 A 11/1999

JP 2001196816 A 7/2001

* cited by examiner

*Primary Examiner* — Dameon E Levi

*Assistant Examiner* — Collin Dawkins

(74) *Attorney, Agent, or Firm* — Kilyk & Bowersox, P.L.L.C.

(57) ABSTRACT

Provided is a distributor capable of reducing insertion loss while suppressing a ratio in power distribution among output lines from being changed. The distributor 4 is a distributor that is connected with an input line Lin and output lines Lo1 to Lo3 respectively formed on a dielectric substrate 10 as microstrip lines, and distributes to the output lines Lo1 to Lo3 high frequency power fed from a feeding point to a branching point through the input line Lin. In addition, the distributor 4 is configured to include a stub area 42 that is formed in the input line Lin, is separated from the branching point 41, and has a rectangular shape wider than line widths of a first area La and a second area Lb of the input line Lin. The stub area 42 is arranged in a position where the distance $d_1$ between an edge on the feeding point side and lateral edges 3*a* on an input side of the output lines Lo1 and Lo3 substantially perpendicular to the input line Lin is substantially equal to $(\lambda g/4)\times(2n+1)$ where $\lambda g$ is a guide wavelength and n is an integer.

9 Claims, 9 Drawing Sheets

VARIATION

PRESENT INVENTION

| | present invention | variation |
|---|---|---|
| reflection amount | 0.09 | 0.14 |
| transmission amount of Lo1 | 0.88 | 0.89 |
| transmission amount of Lo2 | 1.00 | 1.00 |
| transmission amount of Lo3 | 0.88 | 0.88 |

FIG. 3

PRIOR ART 2

PRIOR ART 1

| | prior art 1 | prior art 2 |
|---|---|---|
| reflection amount | 0.83 | 0.09 |
| transmission amount of Lo1 | 0.88 | 0.81 |
| transmission amount of Lo2 | 1.00 | 1.00 |
| transmission amount of Lo3 | 0.88 | 0.81 |

FIG. 9

DISTRIBUTOR AND PLANAR ANTENNA

TECHNICAL FIELD

The present invention relates to a distributor and a planar antenna, and more specifically, to improvement of a distributor that is connected with an input line and two or more output lines respectively formed on a dielectric substrate as microstrip lines, and distributes high frequency power fed from a feeding point to a branching point through the input line to the two or more output lines.

BACKGROUND ART

A microstrip antenna is a planar antenna in which a feed line extending with a substantially constant width and radiating elements excited by a traveling wave propagating through the feed line are formed on a dielectric substrate, and fed with power using a waveguide or the like. The feed line is a microstrip line configured to include a microstrip conductor formed on the front surface of the dielectric substrate and a grounding plate formed on the back surface of the dielectric substrate. Such a planar antenna uses a distributor in order to distribute high frequency power according to the number of radiating elements. The distributor is a power distributing circuit adapted to distribute the high frequency power fed from a feeding point to a branching point through an input line to two or more output lines (see, for example, Patent Literatures 1 and 2).

CITATION LIST

Patent Literature

Patent Literature 1: Japanese Unexamined Patent Publication JP-H11-330811-A

Patent Literature 2: Japanese Unexamined Patent Publication JP-2001-196816-A

SUMMARY OF INVENTION

Technical Problem

A conventional distributor has the problem of having a large reflection amount and large insertion loss. Also, providing an impedance transformer to reduce a reflection amount gives rise to the problem of changing a ratio in power distribution among output lines.

FIG. 8A and FIG. 8B are a diagram illustrating conventional distributors 100 and 110. FIG. 8A illustrates, as a conventional example 1, the distributor 100 that distributes high frequency power fed through an input line Lin extending in a vertical direction to output lines Lo1 to Lo3. The distributor 100 includes a conductor pattern formed on a dielectric substrate. In addition, the distributor 100 has a branching point 101 connected with the input line Lin and the output lines Lo1 to Lo3, and is fed with the high frequency power from the top end 102 of the input line Lin as a feeding point. Further, the output lines Lo1 and Lo3 extend in a horizontal direction, and the output line Lo2 extends in the vertical direction.

A ratio in power distribution among the output lines Lo1 to Lo3 is determined by the characteristic impedances of the output lines Lo1 to Lo3. Also, the characteristic impedance of a feed line is determined by the width of the line, dielectric constant of the dielectric substrate, thickness of the dielectric substrate, and the like. For this reason, changing the widths of the output lines Lo1 to Lo3 can adjust the ratio in power distribution among the output lines Lo1 to Lo3. However, the distributor 100 illustrated had a large reflection amount and large insertion loss.

FIG. 8B illustrates, as a conventional example 2, the distributor 110 including an impedance transformer 111 on an input side of a branching point 101. The distributor 110 includes the impedance transformer 111 of a shape formed by expanding the line width of a bottom end part of an input line Lin left and right. The impedance transformer 111 is a matching circuit for matching the input line Lin and the branching point 101 with each other, and arranged adjacent to lateral edges of output lines Lo1 and Lo3 on the input side. The length of the impedance transformer 111 in a line length direction is substantially quarter a guide wavelength, and the length in the horizontal direction has a value corresponding to the geometric mean between the characteristic impedance of the input line Lin and the combined impedance of the branching point 101.

FIG. 9 is a diagram illustrating the operation characteristics of the distributors 100 and 110 in FIG. 8A and FIG. 8B, in which a reflection amount and transmission amounts of the output lines Lo1 and Lo3 are given for each of the distributors 100 and 101 with a transmission amount of the output line Lo2 assumed to be 1.00. In the case of the distributor 100, the transmission amounts of the output lines Lo1 and Lo3 are 0.88, whereas the reflection amount is 0.83, from which it turns out that high frequency power comparable to the transmission amounts is reflected at the branching point 101. As described, the large reflection amount decreases high frequency powers to be fed to the output lines Lo1 to Lo3.

On the other hand, in the case of the distributor 110, the reflection amount is 0.09, which is very small. However, the transmission amounts of the output lines Lo1 and Lo3 are 0.81, and as compared with the distributor 100 not including the impedance transformer 111, it turns out that a ratio in power distribution is small. As described, the change in power distribution ratio among the output lines Lo1 to Lo3 prevents high frequency power from being appropriately distributed to respective radiating elements, and consequently, desired directivity cannot be obtained.

The present invention is made in consideration of the above situations, and intends to provide a distributor capable of reducing insertion loss while suppressing a ratio in power distribution among output lines from being changed. In particular, the present invention intends to provide a distributor capable of reducing insertion loss while suppressing a ratio in power distribution from being changed from a value corresponding to the line widths of output lines.

Also, the present invention intends to provide a planar antenna capable of obtaining desired directivity while reducing the insertion loss of a distributor.

Solution to Problem

A distributor according to a first aspect of the present invention is a distributor that is connected with an input line and two or more output lines respectively formed on a dielectric substrate as microstrip lines, and distributes to said two or more output lines high frequency power fed from a feeding point to a branching point through the input line. In addition, the distributor includes a stub area that is formed in the input line, is separated from the branching point, and has a rectangular shape wider than line widths of the input line on a feeding point side and on a branching point side. Further, the stub area is configured to be arranged in a position where the distance between an edge on the feeding point side and lateral edges on an input side of the output lines substantially perpendicular to the input line is substantially equal to $(\lambda g/4)\times(2n+1)$ where $\lambda g$ is a guide wavelength and n is an integer.

In such a configuration, since the difference in propagation path is an odd multiple of the half wavelength, after propagation through the input line, a reflected wave reflected at a position corresponding to the edge of the stub area on the feeding point side, and a reflected wave reflected at a position corresponding to the lateral edges on the input side of the output lines substantially perpendicular to the input line are mutually cancelled out by interference. For this reason, a reflection amount when the high frequency power is fed to the branching point through the input line can be reduced to reduce the insertion loss of the distributor. Also, by separating the stub area from the branching point, an area narrower in line width than the stub area is formed between the stub area and the branching point, and therefore the electromagnetic coupling between the stub area and the output lines can be weakened. For this reason, a ratio in power distribution can be suppressed from being changed from a value corresponding to the line widths of the output lines.

A distributor according to a second aspect of the present invention is, in addition to the above configuration, configured such that the length of the stub area in a line length direction is substantially equal to $(\lambda g/4)\times(2m+1)$ where m is an integer. In such a configuration, since the difference in propagation path is an odd multiple of the half wavelength, after propagation through the input line, a reflected wave reflected at the position corresponding to the edge of the stub area on the feeding point side, and a reflected wave reflected at a position corresponding to an edge of the stub area on the side opposite to the feeding point, i.e., an edge on the branching point side are mutually cancelled out by interference. For this reason, the reflection amount when the high frequency power is fed to the branching point through the input line can be further reduced.

A distributor according to a third aspect of the present invention is, in addition to the above configuration, configured such that the line widths of the input line on the branching point side rather than the stub area and on the feeding point side rather than the stub area are substantially equal to each other. In such a configuration, since the line width of the input line is the same as that in the case where the stub area is not provided, a ratio in power distribution between the output lines corresponding to that in the case where the stub area is not provided can be achieved.

A distributor according to a fourth aspect of the present invention is, in addition to the above configuration, configured such that the stub area includes two protrusion parts that protrude from both lateral edges of the input line in mutually opposite directions. In the case of a distributor of which an input line and two output lines substantially perpendicular to the input line are connected to each other at a branching point, the configuration according to the fourth aspect makes it possible to uniformly distribute high frequency power to the output lines.

A distributor according to a fifth aspect of the present invention is, in addition to the above configuration, configured such that the branching point is formed as a cross-shaped area connected with the input line, two of the output lines substantially perpendicular to the input line, and one output line substantially parallel to the input line. Such a configuration makes it possible to reduce a reflection amount at the branching point while suppressing a ratio in power distribution between the two output lines substantially perpendicular to the input line from being changed.

A planar antenna according to a sixth aspect of the present invention includes: feed lines that are formed on a dielectric substrate as microstrip lines; a distributor that is connected with an input line and two or more output lines respectively as the feed lines, and distributes high frequency power fed from a feeding point to a branching point through the input line to the two or more output lines; and two or more radiating elements that are excited by traveling waves propagating through the output lines. In addition, the distributor has a stub area that is formed in the input line, is separated from the branching point, and has a rectangular shape wider than line widths of said input line on a feeding point side and on a branching point side. Further, the stub area is configured to be arranged in a position where the distance between an edge on the feeding point side and lateral edges on an input side of the output lines substantially perpendicular to the input line is substantially equal to $(\lambda g/4)\times(2n+1)$ where $\lambda g$ is a guide wavelength and n is an integer.

In such a configuration, since the difference in propagation path is an odd multiple of the half wavelength, after propagation through the input line, a reflected wave reflected at a position corresponding to the edge of the stub area on the feeding point side, and a reflected wave reflected at a position corresponding to the lateral edges on the input side of the output lines substantially perpendicular to the input line are mutually cancelled out by interference. For this reason, a reflection amount when the high frequency power is fed to the branching point of the distributor through the input line can be reduced to reduce the insertion loss of the distributor. Also, by separating the stub area from the branching point, an area narrower in line width than the stub area is formed between the stub area and the branching point, and therefore the electromagnetic coupling between the stub area and the output lines can be weakened. For this reason, a ratio in power distribution can be suppressed from being changed from a value corresponding to the line widths of the output lines. As a result, the planar antenna is capable of obtaining desired directivity because the high frequency power is appropriately distributed to the respective output lines by the distributor and supplied to the respective radiating element.

Effects of Invention

The present invention can provide a distributor capable of reduce insertion loss while suppressing a ratio in power distribution among output lines from being changed. In particular, the present invention can provide a distributor capable of reducing insertion loss while suppressing a ratio in power distribution from being changed from a value corresponding to the line widths of output lines.

Also, the planar antenna according to the present invention is capable of obtaining desired directivity while reducing the insertion loss of a distributor.

BRIEF DESCRIPTION OF DRAWINGS

FIG. 3 is a diagram illustrating an example of the operation characteristics of the distributors 4 in FIG. 2A and FIG. 2B, in which a reflection amount and transmission amounts of the output lines Lo1 and Lo3 are given for each of the distributors 4 with a transmission amount of the output line Lo2 assumed to be 1.00;

FIG. 9 is a diagram illustrating the operation characteristics of the distributors 100 and 110 in FIG. 8A and FIG. 8B.

DESCRIPTION OF EMBODIMENTS

Figure 1:
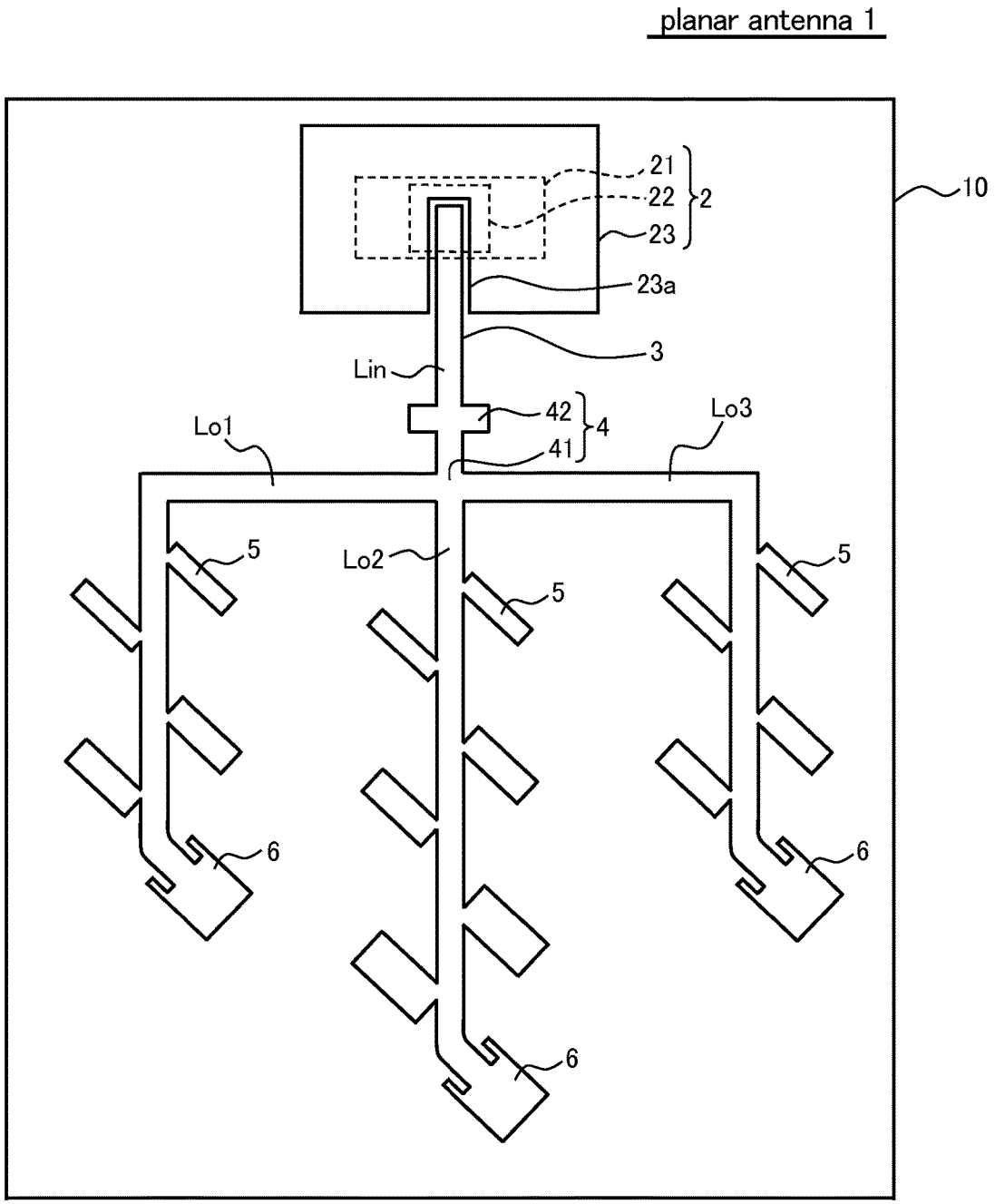
FIG. 1 is a diagram illustrating a configuration example of a planar antenna 1 according to an embodiment of the present invention, in which the front surface of the planar antenna 1 is illustrated.

In the following description, the top, bottom, left, and right refer to those with each of the drawing sheets as a reference.

<Planar Antenna 1>

FIG. 1 is a diagram illustrating a configuration example of a planar antenna 1 according to an embodiment of the present invention, in which the front surface of the planar antenna 1 is illustrated. The planar antenna 1 is a microstrip antenna in which conductive layers are formed on both surfaces of a dielectric substrate 10 formed in a tabular shape, and fed with high frequency power through a waveguide (not illustrated). In the planar antenna 1, a converter 2, feed lines 3, a distributor 4, radiating elements 5, and matching elements 6 are formed on the dielectric substrate 10. The waveguide is formed as a hollow structure that transmits an electromagnetic wave in the microwave or milliwave band in a tube axis direction, and arranged so as to protrude from the back surface of the dielectric substrate 10.

The dielectric substrate 10 is an antenna substrate made of a dielectric. As the dielectric substrate 10, for example, a rectangular-shaped printed substrate made of a fluorine resin or an insulating resin is used. Each of the feed lines 3 is a transmission line through which a traveling wave propagates, and formed as a microstrip line extending with a substantially constant width along the front surface of the dielectric substrate 10.

Each of the feed lines 3 is configured to include the dielectric substrate 10, a microstrip conductor formed on the front surface of the dielectric substrate 10, and a grounding plate (not illustrated) formed on the back surface of the dielectric substrate 10. The grounding plate is formed as a conductor pattern adapted to function as a ground electrode for the feed lines 3 and the distributor 4, and almost covers the entire back surface of the dielectric substrate 10.

The converter 2 is a power conversion circuit that converts the high frequency power between the waveguide and the feed line 3, and configured to include an opening part 21 formed in the grounding plate, a matching element 22 formed inside the opening part 21, and a shorting plate 23 formed on the front surface of the dielectric substrate 10. The waveguide is fixed to the planar antenna 1 with an end surface thereof being in contact with the grounding plate.

The opening part 21 forms a rectangular-shaped closing area that closes the waveguide, and has dimensions corresponding to wide walls and narrow walls of the waveguide. For example, the opening part 21 is a laterally-long rectangular-shaped through-hole penetrating through the grounding plate, and arranged with the long sides corresponding to the wide walls of the waveguide and the short sides corresponding to the narrow walls. The matching element 22 is a resonator adapted to resonate the electromagnetic wave, and has a rectangular-shaped conductor pattern formed in an island shape inside the opening part 21.

The shorting plate 23 has a rectangular-shaped conductor pattern for shorting the waveguide, and covers the opening part 21 as well as being formed with a cutout 23*a* for arranging the feed line 3. The cutout 23*a* is formed in the central part of the opening part 21 in the horizontal direction, in which the top end part of the feed line 3 extending in the vertical direction is arranged. The top end part of the feed line 3 crosses the long edge of the opening part 21 and the bottom edge of the matching element 22. In the planar antenna 1, the high frequency power is fed to the feed line 3 from the converter 2 as a feeding point.

The distributor 4 is a power distributing circuit that is connected with an input line Lin and output lines Lo1 to Lo3, and distributes the high frequency power fed from the feeding point to a branching point 41 through the input line Lin to the two or more output lines Lo1 to Lo3. The distributor 4 is a three-branching type distributing circuit that distributes the high frequency power to the three output lines Lo1 to Lo3, and has the branching point 41 connected with the input line Lin and the output lines Lo1 to Lo3, and a stub area 42 wider in line width than the input line Lin.

All of the input line Lin and the output lines Lo1 to Lo3 are the feed lines 3 formed on the dielectric substrate 10 as the microstrip lines. The input line Lin linearly extends from the branching point 41 toward the top, and the top end part thereof is arranged in the cutout 23*a* of the shorting plate 23. The output line Lo1 linearly extends from the branching point 41 toward the left. The output line Lo1 bends on the way, and connects to the feed line 3 extending toward the bottom.

The output line Lot linearly extends from the branching point 41 toward the bottom. The output line Lo3 linearly extends from the branching point 41 toward the right. The output line Lo3 bends on the way, and connects to the feed line 3 extending toward the bottom. The stub area 42 functions as a reflection suppressing element adapted to suppress reflection at the branching point 41, and is provided in the input line Lin.

Each of the radiating elements 5 is an antenna element that is excited by a traveling wave propagating through a corresponding feed line 3 to radiate an electromagnetic wave to free space, and has a shape extending in a direction intersecting with the feed line 3. The radiating element 5 is connected to the feed line 3 at one end, and opened at the other end. The element length of the radiating element 5 is substantially half a guide wavelength λg. The guide wavelength λg is a wavelength of the electromagnetic wave propagating through the feed line 3.

In the planar antenna 1, the two or more radiating elements 5 are formed along the feed lines 3, and each of the radiating elements 5 has a rectangular-shaped conductor pattern. The number and shapes of the radiating elements 5 are determined depending on performance and directional characteristics required for the planar antenna 1. Each of the matching elements 6 is a termination circuit adapted to terminate a corresponding feed line 3, and has a rectangular-shaped conductor pattern. The matching element 6 is arranged at the bottom end of the feed line 3.

Along the output line Lo2, six radiating elements 5 are arranged, and along each of the output lines Lo1 and Lo3, four radiating elements 5 are arranged. These radiating elements 5 are arranged so as to radiate to free space the electromagnetic waves respectively having the same phases and uniform polarization planes, all of which tilt with respect to the lateral edges of the feed lines 3. Also, the radiating elements 5 are provided along both lateral edges of the corresponding feed lines 3.

Radiating elements 5 formed along the right lateral edge of each of feed lines 3 are arranged at predetermined intervals so as to be excited at mutually the same phase. For example, the respective radiating elements 5 are arranged at intervals equal to an integral multiple of the guide wavelength λg. Also, these radiating elements 5 are arranged parallel to each other to make the polarization planes uniform. Further, in order to make it possible to obtain desired directivity, the element widths of the respective radiating elements 5 are made different. For example, the element width of a radiating element 5 increases with increasing distance from the feeding point. Radiating elements 5 formed along the left lateral edge of the feed line 3 are also configured to be similar to the radiating elements 5 formed along the right lateral edge of the feed line 3.

The conductor patterns included in the converter 2, feed lines 3, distributor 4, radiating elements 5, and matching elements 6 are fabricated by attaching a metal thin film, e.g., copper foil, on the dielectric substrate 10 and patterning the metal thin film on the dielectric substrate 10 by etching or the like. The line widths of the feed lines 3 are determined depending on a frequency, bandwidth, and radiation characteristics of an electromagnetic wave to be transceived. Also, the line widths of the feed lines 3 are shorter than the guide wavelength λg.

<Distributor 4>

Figure 2B:
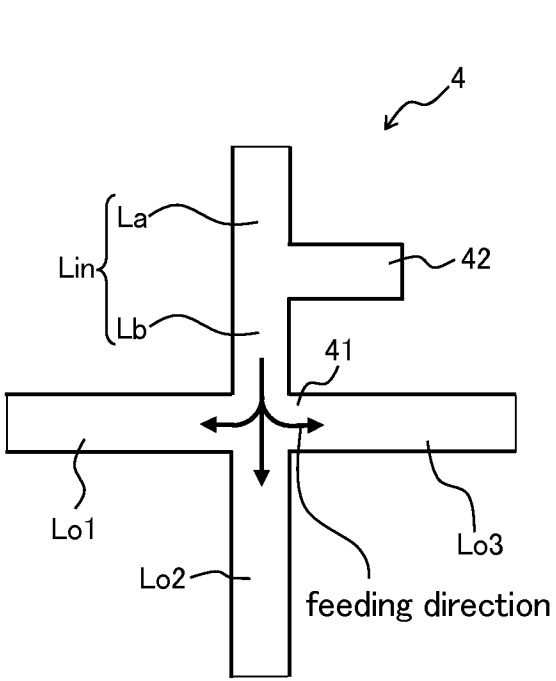
FIG. 2B is a diagram illustrating a variation of the distributor 4 in FIG. 4.
Figure 2A:
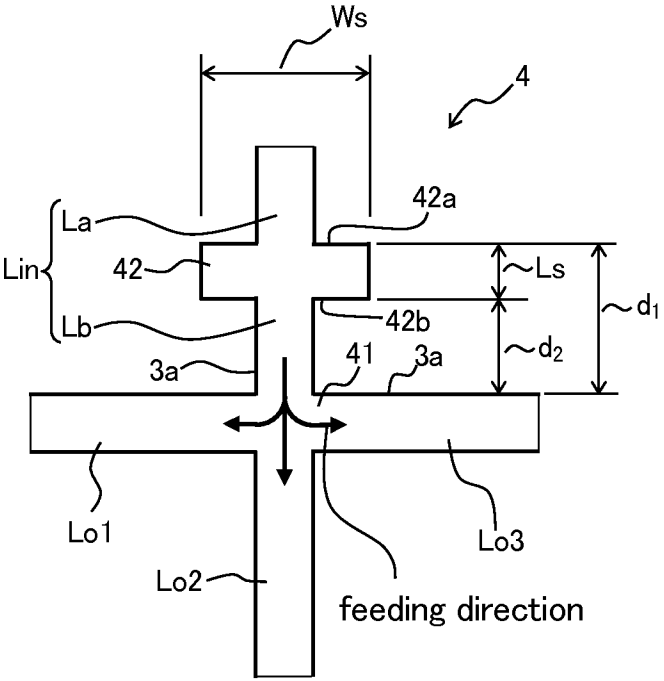
FIG. 2A is a diagram illustrating the distributor 4 in FIG. 1 on an enlarged scale.

FIG. 2A and FIG. 2B are diagrams illustrating configuration examples of the distributor 4 in FIG. 1. FIG. 2A illustrates the distributor 4 in FIG. 1 on an enlarged scale, and FIG. 2B illustrates a variation of the distributor 4. Both of the output lines Lo1 and Lo3 are the feed lines substantially perpendicular to the input line Lin. On the other hand, the output line Lo2 is the feed line substantially parallel to the input line Lin. The line widths of the input line Lin and the output lines Lo1 to Lo3 are substantially equal to one another.

The distributor 4 is configured to include the branching point 41 formed as a cross-shaped area and the rectangular-shaped stub area 42. The stub area 42 is formed in the input line Lin, separated from the branching point 41, and of a convex shape formed by expanding the line width of the input line Lin left and right. Note that a part of the input line Lin on the feeding point side rather than the stub area 42 is referred to as a first area La, and a part on the branching point side rather than the stub area 42 is referred to as a second area Lb.

The stub area 42 is a rectangular-shaped area of which the line width Ws is wider than the line width of the first area La and the line width of the second area Lb. Accordingly, the second area Lb is narrower in line width than the stub area 42, and functions as a coupling buffer area adapted to weaken the electromagnetic coupling between the stub area 42 and the output lines Lo1 and Lo3.

In the case of the distributor 4 illustrated in FIG. 2A, the stub area 42 includes two protrusion parts that protrude from both lateral edges 3*a* of the input line Lin in mutually opposite directions. The lengths in the horizontal direction of the protrusion parts on the left and right sides rather than the input line Lin are substantially equal to each other. That is, the length of the protrusion part protruding from the right lateral edge 3*a* of the input line Lin and the length of the protrusion part protruding from the left lateral edge 3*a* are substantially the same. Such a configuration makes it possible to uniformly distribute the high frequency power to the output lines Lo1 and Lo3. In the case of a distributor 4 illustrated in FIG. 2B, a stub area 42 includes one protrusion part that protrudes from the right lateral edge 3*a* of an input line Lin.

The stub area 42 corresponds to an open stub because the fore ends of the protrusion parts are open ends. The stub area 42 is arranged in a position where the distance $d_1$ between the input edge 42*a* of the stub area 42 and the lateral edges 3*a* on an input side of the output lines Lo1 and Lo3 is substantially equal to $(\lambda g/4)\times(2n+1)$ where λg is the guide wavelength and n is an integer. The input edge 42*a* is an edge on the feeding point side between the two edges of the stub area 42 extending in the horizontal direction. The term "substantially equal" means that the difference between the distance $d_1$ and $(\lambda g/4)\times(2n+1)$ is sufficiently small as compared with the guide wavelength λg. For example, the difference is λg/8 or less.

In such a configuration, since the difference $2d_1$ in propagation path is an odd multiple of the half wavelength (λg/2), after propagation through the input line Lin, a reflected wave reflected at a position corresponding to the input edge 42*a* of the stub area 42, and a reflected wave reflected at a position corresponding to the lateral edges 3*a* on the input side of the output lines Lo1 and Lo3 are mutually cancelled out by interference. For this reason, a reflection amount when the high frequency power is fed to the branching point 41 through the input line Lin can be reduced to reduce the insertion loss of the distributor 4. It can be understood that this is because input impedance as seen from the feeding point side is matched between the position corresponding to the input edge 42*a* of the stub area 42 and the position corresponding to the lateral edges 3*a* on the input side of the output lines Lo1 and Lo3 at the branching point 41.

Also, by separating the stub area 42 from the branching point 41, the first area Lb narrower in line width than the stub area 42 is formed between the branching point 41 and the stub area 42, and therefore the electromagnetic coupling between the stub area 42 and the output lines Lo1 and Lo3 can be weakened. For this reason, a ratio in power distribution can be suppressed from being changed from a value corresponding to the line widths of the output lines Lo1 and Lo3.

The stub area 42 has a stub length Ls substantially equal to $(\lambda g/4)\times(2m+1)$ where m is an integer. The stub length Ls is length in a line length direction, i.e., in the vertical direction, and given that between the two edges of the stub area 42 extending in the horizontal direction, an edge on an edge opposite to the feeding point i.e., an edge on the branching point side is referred to as an output edge 42*b*, corresponds to the distance between the input edge 42*a* and the output edge 42*b*. Both of the input edge 42*a* and the output edge 42*b* are edges substantially perpendicular to the lateral edges 3*a* of the input line Lin. For example, the distributor 4 has a conductor pattern having $d_1=\lambda g/4)\times 3$, $Ls=(\lambda g/4)$, and $d_2=(\lambda g/2)$.

In such a configuration, since the difference 2 Ls in propagation path is an odd multiple of the half wavelength ($\lambda g/2$), after propagation through the input line Lin, a reflected wave reflected at the position corresponding to the input edge 42*a* of the stub area 42, and a reflected wave reflected at a position corresponding to the output edge 42*n* of the stub area 42 are mutually cancelled out by interference. For this reason, the reflection amount when the high frequency power is fed to the branching point 41 through the input line Lin can be further reduced.

Note that the distance $d_2$ between the output side 42*b* and the lateral edges 3*a* on the input side of the output lines Lo1 and Lo3 is $d_2=(d_1-Ls)$. For this reason, in the case where the distance $d_1$ is $d_1=(\lambda g/4)\times(2n+1)$ and the stub length Ls is $Ls=(\lambda g/4)\times(2m+1)$, the distance $d_2$ is an integral multiple of the half wavelength ($\lambda g/2$).

The line width Ws of the stub area 42 is determined by the characteristic impedances of the input line Lin and the output lines Lo1 to Lo3. For example, the line width Ws has length corresponding to the geometric mean between the characteristic impedance of the input line Lin and the combined impedance of the branching point 41. Also, the line width of the second area Lb is substantially equal to that of the first area La. In such a configuration, since the line width of the input line Lin is the same as that in the case where the stub area 42 is not provided, a ratio in power distribution between the output lines Lo1 and Lo3 corresponding to that in the case where the stub area 42 is not provided can be achieved.

FIG. 3 is a diagram illustrating the operation characteristics of the distributors 4 in FIG. 2A and FIG. 2B, in which a reflection amount and transmission amounts of the output lines Lo1 and Lo3 are given for each of the distributors 4 with a transmission amount of the output line Lo2 assumed to be 1.00. In the case of the distributor 4 illustrated in FIG. 2A, the transmission amounts of the output lines Lo1 and Lo3 are 0.88, whereas the reflection amount is 0.09, which is very small.

When comparing the operation characteristics of this distributor 4 with the operation characteristics of the distributor 110 including the impedance transformer 111, it turns out that the distributor 4 can suppress reflection to the same degree as the distributor 110. On the other hand, the transmission amounts of the output lines Lo1 and Lo3 are 0.88, from which it turns out that a ratio in power distribution corresponding to that of the distributor 100 not including the impedance transformer 111 is achieved.

In the case of the distributor 4 illustrated in FIG. 2B, the reflection amount is 0.14 which is very small, whereas the transmission amount of the output line Lo1 is 0.89, and the transmission amount of the output line Lo3 is 0.88. In this distributor 4, the protrusion length of the stub area 42 from a lateral edge 3*a* of the input line Lin is asymmetric between the left and right of the input line Lin, and therefore a ratio in power distribution is different between the left and the right.

That is, by making the protrusion length of the stub area 42 different between the left and the right, the ratio in power distribution between the output lines Lo1 and Lo3 can be adjusted. For example, by increasing the protrusion length on the output line Lo3 side (right side), a power distribution ratio of the output line Lo1 can be made larger than that of the output line Lo3.

Figure 4:
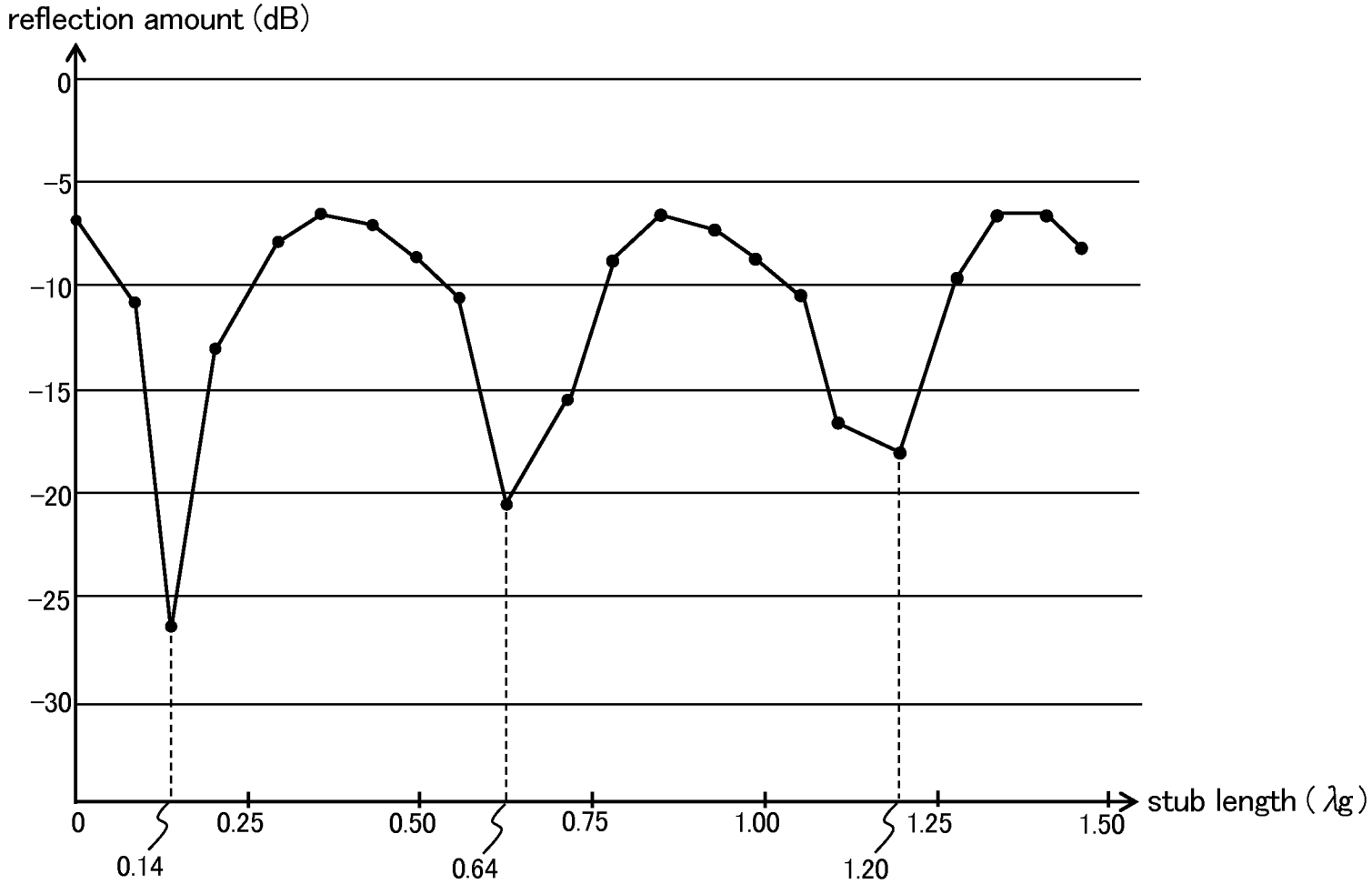
FIG. 4 is a diagram illustrating an example of the operation characteristics of the distributor 4, in which reflection characteristics when the stub length Ls was changed without a change in the position of the input edge 42*a* are illustrated.

FIG. 4 is a diagram illustrating an example of the operation characteristics of the distributor 4, in which reflection characteristics when the stub length Ls was changed without a change in the position of the input edge 42*a* are illustrated. This diagram illustrates an analysis result of the reflection characteristics with the horizontal axis as the stub length ($\lambda g$) and the vertical axis as the reflection amount (dB). For example, the input edge 42*a* is fixed at a position where the distance $d_1$ from the lateral edges 3*a* on the input side of the output lines Lo1 and Lo3 exceeds double the guide wavelength $\lambda g$.

In this analysis result, the reflection amount takes local minimum values of −26.6 dB at Ls=0.14, −20.8 dB at Ls=0.64 and −17.8 dB at Ls=1.20, whereas the reflection amount is −7.1 dB at the stub length Ls=0, i.e., in the case where the stub area 42 is not provided. That is, when the stub length Ls reaches a predetermined value shorter than $\lambda g/4$, the reflection amount takes the minimum first, and as the stub length Ls is increased, a minimum appears at repetition intervals of approximately $\lambda g/2$.

Figure 5:
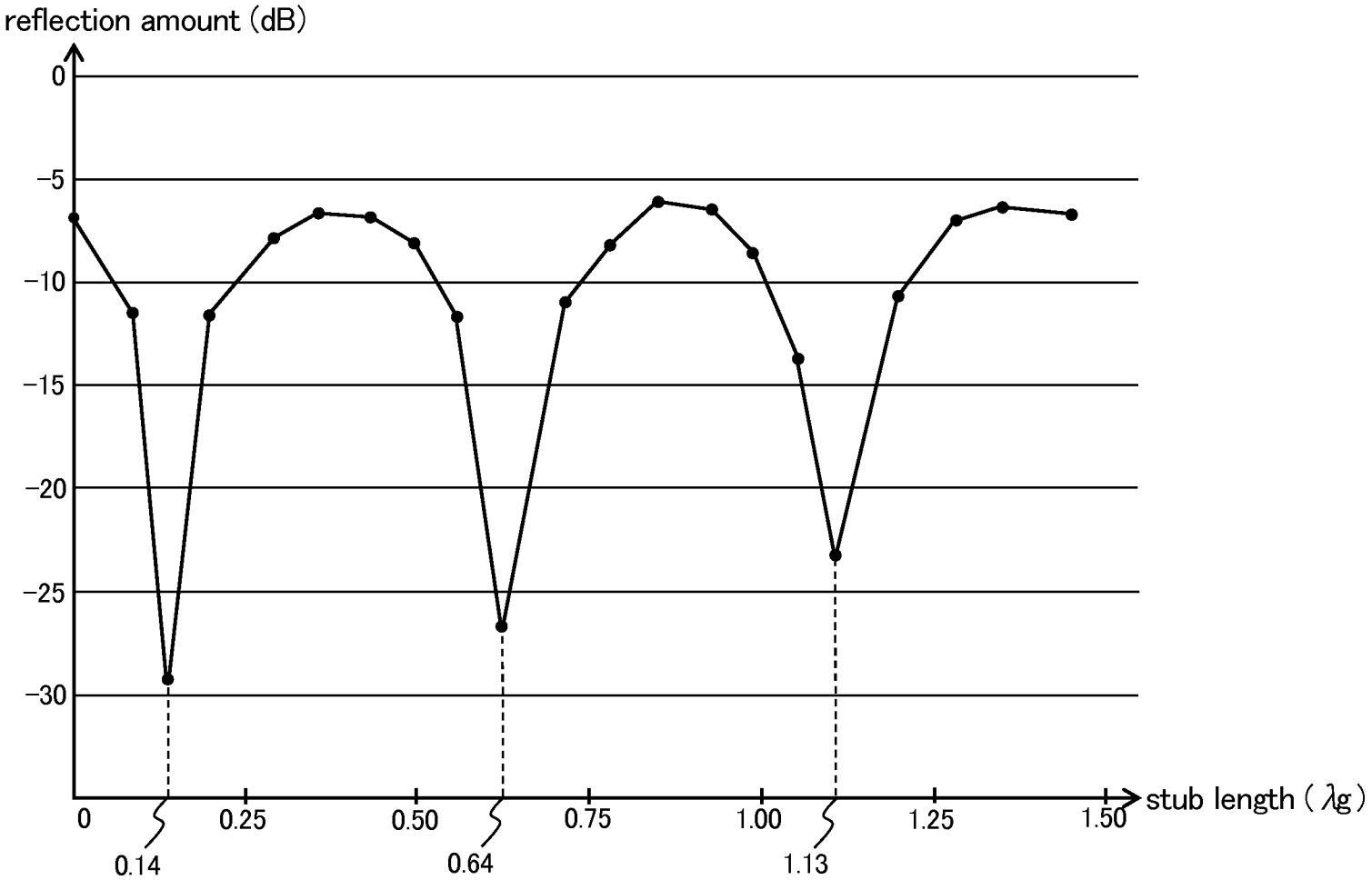
FIG. 5 is a diagram illustrating an example of the operation characteristics of the distributor 4, in which reflection characteristics when the stub length Ls was changed without a change in the position of the output edge 42*b* are illustrated.

FIG. 5 is a diagram illustrating an example of the operation characteristics of the distributor 4, in which reflection characteristics when the stub length Ls was changed without a change in the position of the output edge 42*b* are illustrated. This diagram illustrates an analysis result of the reflection characteristics with the horizontal axis as the stub length ($\lambda g$) and the vertical axis as the reflection amount (dB). For example, the output edge 42*b* is fixed at a position where the distance $d_2$ from the lateral edges 3*a* on the input side of the output lines Lo1 and Lo3 is half the guide wavelength $\lambda g$.

In this analysis result, the reflection amount takes minimum values of −29.4 dB, −26.9 dB, and −23.5 dB at Ls=0.14, 0.64, and 1.13, whereas the reflection amount is −7.1 dB at the stub length Ls=0. That is, when the stub length Ls reaches a predetermined value shorter than $\lambda g/4$, the reflection amount takes the minimum first, and as the stub length Ls is increased, a minimum appears at repetition intervals of approximately $\lambda g/2$.

When fixing the output edge 42*b* at a position where the distance $d_2$ from the lateral edges 3*a* on the input line side of the output lines Lo1 and Lo3 is $(\lambda g/2)\times(2k+1)$ (where k is an integer equal to or more than 1) as well, reflection characteristics similar to those when the output side 42*b* was fixed at the position corresponding to ($\lambda g/2$) can be obtained.

Figure 6:
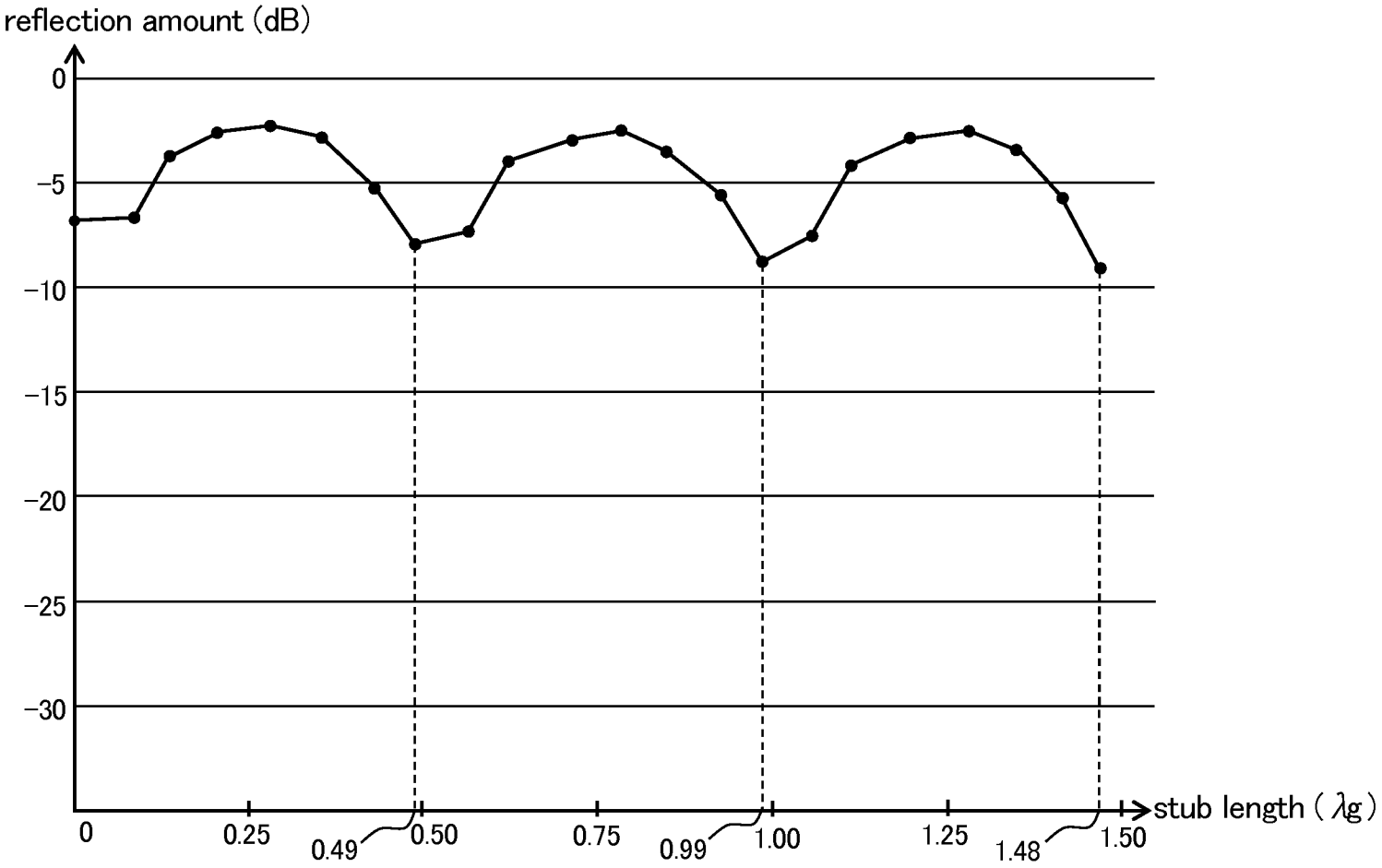
FIG. 6 is a diagram illustrating an example of the operation characteristics of the distributor 4, in which reflection characteristics when the input edge 42*a* was fixed at a position where the distance $d_1$ is an integral multiple of half the guide wavelength λg are illustrated.

FIG. 6 is a diagram illustrating an example of the operation characteristics of the distributor 4, in which reflection characteristics when the input side 42*a* was fixed at a position where the distance $d_1$ is an integral multiple of half the guide wavelength $\lambda g$ are illustrated. This diagram illustrates an analysis result of the reflection characteristics with the horizontal axis as the stub length (λg) and the vertical axis as the reflection amount (dB). For example, the input edge 42*a* is fixed at a position where the distance $d_1$ from the lateral edges 3*a* on the input side of the output lines Lo1 and Lo3 is double the guide wavelength λg.

In this analysis result, the reflection amount takes minimum values of −8.1 dB, −8.6 dB, and −9.2 dB at Ls=0.49, 0.99, and 1.48, respectively, whereas the reflection amount is −7.1 dB at the stub length Ls=0. However, it turns out that these minimum values are larger than a target reflection amount, for example, −15 dB; at any point other than the minimum points, the reflection amount is larger than that in the case where the stub area 42 and the second area LB is provided; and the stub length Ls enabling matching is not present.

The reason for such reflection characteristics may be because input impedance as seen from the feeding point side is the same between the position corresponding to the input edge 42*a* of the stub area 42 and the position corresponding to the lateral edges 3*a* on the input side of the output lines Lo1 and Lo3 at the branching point 41 (the both positions have the positional relationship where the reflected waves are combined at the same phase), and therefore cannot be matched even when changing the stub length Ls.

From the analysis results of the reflection characteristics illustrated in FIGS. 4 to 6, (1) it turns out that by arranging the stub area 42 at the point where the distance $d_1$ is substantially equal to (λg/4)×(2n+1), matching is achieved, and the amount of reflection by the distributor 4 is smaller than before. In particular, (2) it turns out that by making the stab length Ls of the stub area 42 substantially equal to (λg/4)×(2n+1), the reflection amount is minimized. On the other hand, (3) it turns out that when arranging the stub area 42 in a position where the distance $d_1$ is equal to (λg/2)×2, matching cannot be achieved, and the amount of reflection by the distributor 4 is larger than before.

Figure 7A:
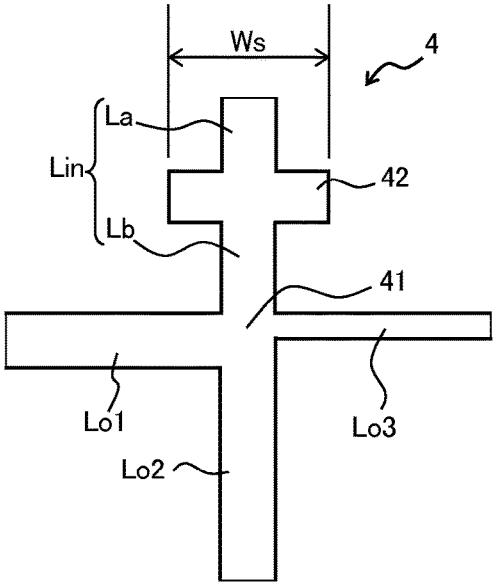
FIG. 7A is a diagram illustrating a three-branching type distributor 4 in which the line width of an output line Lo3 is narrower than those of an input line Lin and output lines Lo1 and Lo2.
Figure 7B:
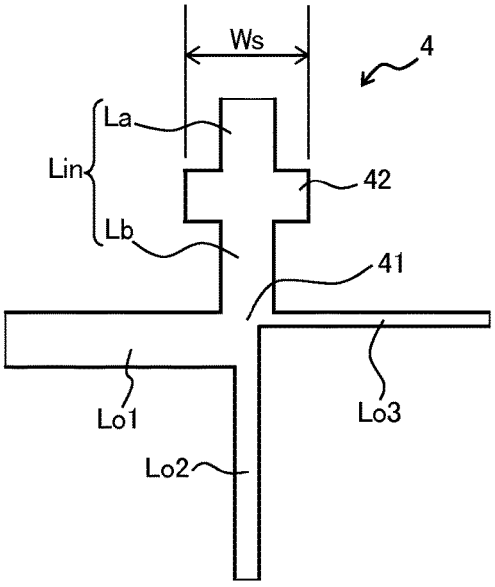
FIG. 7B is a diagram illustrating a three-branching type distributor 4 in which the line width of an output line Lo2 is narrower than those of an input line Lin and an output line Lo1, and the line width of an output line Lo3 is narrower than that of the output line Lo2.

FIG. 7A to FIG. 7D are diagrams illustrating other configuration examples of the distributor 4. FIG. 7A illustrates a three-branching type distributor 4 in which the line width of an output line Lo3 is narrower than those of an input line Lin and output lines Lo1 and Lo2. FIG. 7B illustrates a three-branching type distributor 4 in which the line width of an output line Lo2 is narrower than those of an input line Lin and an output line Lo1, and the line width of an output line Lo3 is narrower than that of the output line Lo2.

Branching points 41 are formed as cross-shaped areas, respectively. The line width Ws of a stub area 42 of the distributor 4 in FIG. 7B is narrower than that of the distributor 4 in FIG. 7A correspondingly to the combined impedance of the branching point 41. Even such distributors 4 asymmetric with respect to the input line Lin can reduce insertion loss while suppressing a ratio in power distribution among the output lines Lo1 to Lo3 from being changed.

Figure 7C:
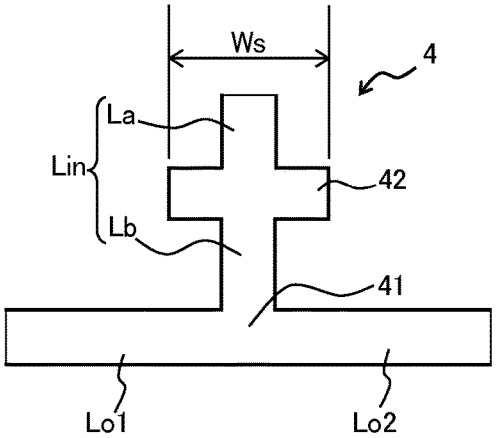
FIG. 7C is a diagram illustrating a two-branching type distributor 4 adapted to distribute high frequency power to two output lines Lo1 and Lo2.

FIG. 7C illustrates a two-branching type distributor 4 adapted to distribute high frequency power to two output lines Lo1 and Lo2. In this distributor 4, a branching point 41 is formed as a T-shaped area, and the output lines Lo1 and Lo2 intersect with an input line Lin at a substantially right angle. Even such a distributor 4 can reduce insertion loss while suppressing a ratio in power distribution between the output lines Lo1 and Lo2 from being changed.

Figure 7D:
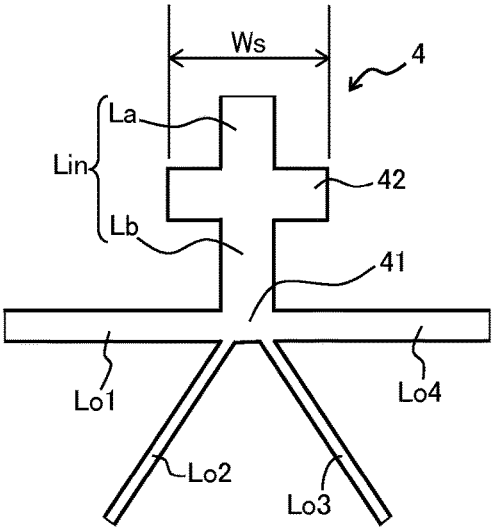
FIG. 7D is a diagram illustrating a four-branching type distributor 4 adapted to distribute high frequency power to four output lines Lo1 to Lo4.
Figure 8B:
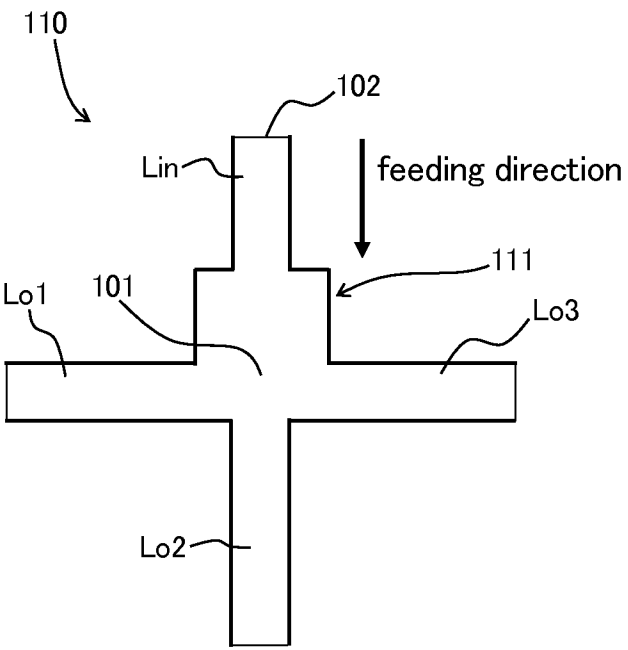
FIG. 8B is a diagram illustrating, as a conventional example 2, the distributor 110 including an impedance transformer 111 on an input side of a branching point 101.
Figure 8A:
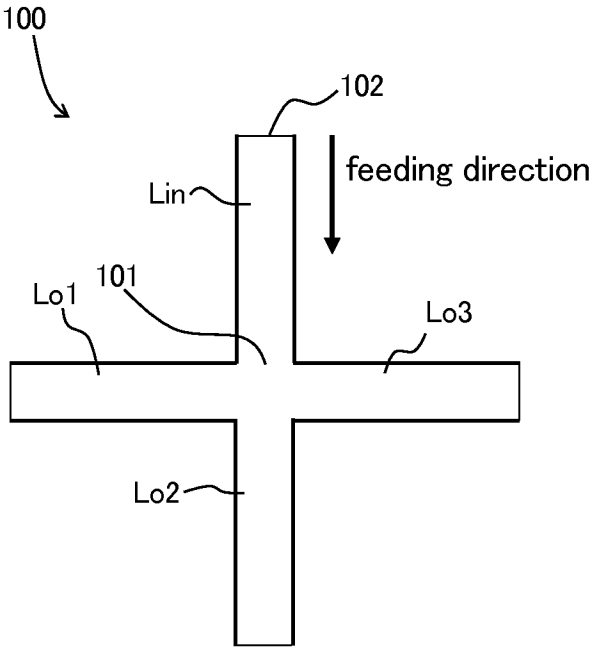
FIG. 8A is a diagram illustrating, as a conventional example 1, the distributor 100 that distributes high frequency power fed through an input line Lin extending in a vertical direction to output lines Lo1 to Lo3.

FIG. 7D illustrates a four-branching type distributor 4 adapted to distribute high frequency power to four output lines Lo1 to Lo4. In this distributor 4, the output line Lo1 and Lo4 intersect with an input line Lin at a substantially right angle. Also, the line widths of the output lines Lo1 and Lo4 are narrower than that of the input line Lin, and the line widths of the output lines Lo2 and Lo3 are narrower than those of the output lines Lo1 and Lo4. Even such a distributor 4 can reduce insertion loss while suppressing a ratio in power distribution among the output lines Lo1 to Lo4 from being changed.

According to the present embodiment, the reflection amount when the high frequency power is fed to the branching point 41 through the input line Lin can be reduced to reduce the insertion loss of the distributor 4. In particular, the reflection amount at the branching point 41 can be reduced while suppressing the ratio in power distribution between the two output lines Lo1 and Lo3 substantially perpendicular to the input line Lin from being changed. Also, by separating the stub area 42 from the branching point 41, the second area Lb narrower in line width than the stub area 42 is formed between the stub area 42 and the branching point 41, and therefore the electromagnetic coupling between the stub area 42 and the output lines Lo1 to Lo3 can be weakened.

Note that in the present embodiment, an example of the case where the line width of the second area Lb is substantially equal to that of the first area La is described. However, the present invention does not limit the line width of the second area Lb to this. For example, the line width of the second area Lb may be wider or narrower than the line width of the first area La as long as being narrower than the line width Ws of the stub area 42.

Also, in the present embodiment, an example of the case where the stub area 42 is arranged in the position where the distance $d_1$ is substantially equal to (λg/4)×(2n+1), and the stub length Ls is substantially equal to (λg/4)×(2m+1) is described. However, the present invention does not limit the configuration of the stub area 42 to this. For example, as long as being arranged in the position where the distance $d_1$ is substantially equal to (λg/4)×(2n+1), the stub area 42 may be configured such that the stub length Ls is not equal to (λg/4)×(2m+1). Also, as long as $d_1$>Ls is met, the second area Lb of the input line Lin is present, and therefore a distributor in which the stub area 42 is arranged in a position where the distance $d_1$ is substantially equal to (λg/4), and the stub length Ls is substantially equal to (λg/4) is also included in the present invention.

The invention claimed is:

1. A distributor that is connected with an input line and two or more output lines respectively formed on a dielectric substrate as microstrip lines, and distributes to said two or more output lines high frequency power fed from a feeding point to a branching point through said input line, the distributor including a stub area that is formed in said input line, is separated from said branching point by a section of said input line having a line width, and said stub area has a rectangular shape wider than a) a line width of said input line on a feeding point side and b) the line width of said section of said input line, wherein said stub area is arranged in a position where a distance between an edge on said feeding point side and lateral edges on an input side of said output lines substantially perpendicular to said input line is substantially equal to (λg/4)×(2n+1) where λg is a guide wavelength and n is an integer, and said input line has an area which is narrower in line width than the stub area and formed between the stub area and the branching point.

2. The distributor according to claim 1, wherein a length of said stub area in a line length direction is substantially equal to (λg/4)×(2m+1) where m is an integer.

3. The distributor according to claim 1, wherein line widths of said input line on said branching point side rather than said stub area and on said feeding point side rather than said stub area are substantially equal to each other.

4. The distributor according to claim 1, wherein said stub area includes two protrusion parts that protrude from both lateral edges of said input line in mutually opposite directions.

5. The distributor according to claim 1, wherein said branching point is formed as a cross-shaped area connected with said input line, two of said output lines substantially perpendicular to said input line, and one output line substantially parallel to said input line.

6. A planar antenna comprising:

feed lines that are formed on a dielectric substrate as microstrip lines;

a distributor that is connected with an input line and two or more output lines respectively as said feed lines, and distributes high frequency power fed from a feeding point to a branching point through said input line to said two or more output lines; and two or more radiating elements that are excited by traveling waves propagating through said output lines, wherein:

said distributor has a stub area that is formed in said input line, is separated from said branching point by a section of said input line having a line width, and said stub area has a rectangular shape wider than a) a line width of said input line on a feeding point side and b) the line width of said section of said input line; and said stub area is arranged in a position where a distance between an edge on said feeding point side and lateral edges on an input side of said output lines substantially perpendicular to said input line is substantially equal to $(\lambda g/4)\times(2n+1)$ where $\lambda g$ is a guide wavelength and n is an integer.

7. The distributor according to claim 2, wherein line widths of said input line on said branching point side rather than said stub area and on said feeding point side rather than said stub area are substantially equal to each other.

8. The distributor according to claim 2, wherein said stub area includes two protrusion parts that protrude from both lateral edges of said input line in mutually opposite directions.

9. The distributor according to claim 2, wherein said branching point is formed as a cross-shaped area connected with said input line, two of said output lines substantially perpendicular to said input line, and one output line substantially parallel to said input line.

* * * * *